US009389551B2

(12) United States Patent
Ishii

(10) Patent No.: US 9,389,551 B2
(45) Date of Patent: Jul. 12, 2016

(54) FIXING UNIT AND IMAGE FORMING APPARATUS INCLUDING SAME

(75) Inventor: Hirokazu Ishii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 23 days.

(21) Appl. No.: 13/181,941

(22) Filed: Jul. 13, 2011

(65) Prior Publication Data

US 2012/0034004 A1 Feb. 9, 2012

(30) Foreign Application Priority Data

Aug. 5, 2010 (JP) ..... 2010-176786

(51) Int. Cl.
*G03G 15/20* (2006.01)

(52) U.S. Cl.
CPC .... *G03G 15/2028* (2013.01); *G03G 2215/2032* (2013.01)

(58) Field of Classification Search
CPC ..... G03G 15/2028; G03G 15/657
USPC ..... 399/322, 316
See application file for complete search history.

(56) References Cited

U.S. PATENT DOCUMENTS

| | | | | |
|---|---|---|---|---|
| 5,515,146 | A | 5/1996 | Harasawa et al. | |
| 5,631,725 | A | 5/1997 | Harasawa et al. | |
| 5,812,919 | A | 9/1998 | Takano et al. | |
| 5,822,667 | A | 10/1998 | Hayama et al. | |
| 5,930,573 | A | 7/1999 | Miyamoto et al. | |
| 6,137,986 | A * | 10/2000 | Sugino | G03G 15/2064 219/216 |
| 6,188,862 | B1 | 2/2001 | Ishii | |
| 6,282,386 | B1 | 8/2001 | Ishii | |
| 6,282,398 | B1 * | 8/2001 | Higashi | G03G 15/2064 219/216 |
| 6,697,583 | B2 | 2/2004 | Ishii | |
| 6,778,802 | B2 | 8/2004 | Kabata et al. | |
| 6,813,467 | B2 | 11/2004 | Kawahara et al. | |
| 6,895,209 | B2 | 5/2005 | Kawahara et al. | |
| 6,961,535 | B2 | 11/2005 | Kawahara et al. | |
| 7,184,678 | B2 | 2/2007 | Ishii et al. | |
| 7,409,182 | B2 | 8/2008 | Ishii | |
| 7,526,242 | B2 * | 4/2009 | Takagaki | G03G 15/167 399/307 |
| 7,769,310 | B2 | 8/2010 | Ishii et al. | |
| 7,813,685 | B2 | 10/2010 | Ishii | |
| 2005/0207802 | A1 * | 9/2005 | Izumi | B65H 29/00 399/316 |

(Continued)

FOREIGN PATENT DOCUMENTS

| | | |
|---|---|---|
| JP | 60-159865 A | 8/1985 |
| JP | 61-47978 A | 3/1986 |

(Continued)

OTHER PUBLICATIONS

Office Action issued Dec. 24, 2013 in Japanese Patent Application No. 2010-176786.

*Primary Examiner* — Clayton E LaBalle
*Assistant Examiner* — Victor Verbitsky
(74) *Attorney, Agent, or Firm* — Oblon, McClelland, Maier & Neustadt, L.L.P.

(57) ABSTRACT

A fixing unit for fixing a toner image includes a fixing device and a guide member. The fixing device includes a fixing roller having a heater inside thereof and a pressing roller disposed opposite the fixing roller. The pressing roller presses against the fixing roller and fixes a toner image formed on a transfer medium. The guide member guides the transfer medium to the fixing device. The guide member includes a metal base member including at least one coating layer.

19 Claims, 16 Drawing Sheets

(56) References Cited

U.S. PATENT DOCUMENTS

| | | | | |
|---|---|---|---|---|
| 2009/0129831 | A1* | 5/2009 | Sakashita | G03G 15/657 399/309 |
| 2009/0220287 | A1* | 9/2009 | Okano | G03G 15/2028 399/322 |
| 2010/0008687 | A1 | 1/2010 | Ishii | |

FOREIGN PATENT DOCUMENTS

| | | | | |
|---|---|---|---|---|
| JP | 61-97678 | A | | 5/1986 |
| JP | 62153865 | A | * | 7/1987 |
| JP | 4-16442 | | | 1/1992 |
| JP | 6-308846 | A | | 11/1994 |
| JP | 8-152794 | | | 6/1996 |
| JP | 2005-156905 | | | 6/2005 |
| JP | 2006-171503 | A | | 6/2006 |
| JP | 2006171503 | A | * | 6/2006 |
| JP | 2007-133046 | | | 5/2007 |
| JP | 2008-139490 | A | | 6/2008 |
| JP | 2008-152126 | | | 7/2008 |
| JP | 2010175952 | A | * | 8/2010 |

* cited by examiner

| | RATE OF OCCURRENCE OF TONER SCATTERING (%) | |
|---|---|---|
| PINHOLE DIAMETER (μm) | LAYER THICKNESS (UPPER LIMIT) 100 μm | LAYER THICKNESS (UPPER LIMIT) 40 μm |
| 200 | 0.179 | 0.1 |
| 190 | 0.179 | 0.1 |
| 170 | 0.179 | 0.0 |
| 160 | 0.710 | 0.0 |
| 150 | 1.430 | 0.0 |

| | SPACIAL DISTANCE BETWEEN LEADING END OF GUIDE MEMBER AND FIXING DEVICE (m) | ELECTRIC POTENTIAL OF GUIDE MEMBER (KV) | ELECTRIC FIELD (KV/m) | TONER SCATTERING |
|---|---|---|---|---|
| (1) 3.64mm | 0.00364 | 0.324 | 8.90E+01 | GOOD |
| (1) 3.64mm | 0.00364 | 0.598 | 1.64E+02 | GOOD |
| (1) 3.64mm | 0.00364 | 0.844 | 2.32E+02 | GOOD |
| (1) 3.64mm | 0.00364 | 0.951 | 2.61E+02 | POOR |
| (1) 3.64mm | 0.00364 | 1.214 | 3.34E+02 | POOR |
| (2) 3.64mm | 0.00364 | 2.000 | 5.49E+02 | POOR |
| (3) 6.04mm | 0.00604 | 2.000 | 3.31E+02 | POOR |

X: SIGNIFICANT CHANGE IN THICKNESS

FIG. 20

| | SPACIAL DISTANCE (m) | TARGET LAYER THICKNESS (μm) | | THICKNESS (2 LAYERS) | ELECTRIC POTENTIAL (LEADING END OF GUIDE MEMBER) KV | ELECTRIC FIELD (KV/m) | TONER SCATTERING |
|---|---|---|---|---|---|---|---|
| | | PRIMER | TEFLON | MEASURED VALUE (μm) | | | |
| (1) 3.64mm | 0.00364 | 10 | 10 | 21 | 0.324 | 8.90E+01 | GOOD |
| (1) 3.64mm | 0.00364 | 10 | 20 | 34 | 0.598 | 1.64E+02 | GOOD |
| (1) 3.64mm | 0.00364 | 20 | 20 | 46 | 0.844 | 2.32E+02 | GOOD |
| (1) 3.64mm | 0.00364 | 20 | 30 | 55 | 0.951 | 2.61E+02 | POOR |
| (1) 3.64mm | 0.00364 | 10 | 40 | 54 | 1.214 | 3.34E+02 | POOR |
| (2) 3.64mm | 0.00364 | | | | 2.000 | 5.49E+02 | POOR |
| (3) 6.04mm | 0.00604 | | | | 2.000 | 3.31E+02 | POOR |

FIG. 21A

| GUIDE MEMBER | DEFAULT SETTING | | | |
|---|---|---|---|---|
| | CHART | SINGLE SURFACE | DUPLEX PRINTING (EVALUATION ON 1ST SIDE) | DUPLEX PRINTING (EVALUATION ON 2ND SIDE) |
| 80 μm | a | C | C | B |
| | b | C | C | B |
| | c | B | B | B |
| | d | C | C | C |
| | e | B | A | A |
| | f | A | A | A |
| | g | A | A | A |
| | h | A | A | A |
| | i | A | A | A |
| | CHART | SINGLE SURFACE | DUPLEX PRINTING (EVALUATION ON 1ST SIDE) | DUPLEX PRINTING (EVALUATION ON 2ND SIDE) |
| 40 μm | a | A | A | B |
| | b | A | A | A |
| | c | A | A | A |
| | d | A | A | A |
| | e | A | A | A |
| | f | A | A | A |
| | g | A | A | A |
| | h | A | A | A |
| | i | A | A | A |

FIG. 21B

ACCELERATION TEST

| | CHART | SINGLE SURFACE | DUPLEX PRINTING (EVALUATION ON 1ST SIDE) | DUPLEX PRINTING (EVALUATION ON 2ND SIDE) |
|---|---|---|---|---|
| | a | C | C | C |
| | b | C | C | B |
| | c | B | B | B |
| | d | C | C | A |
| | e | C | C | B |
| | f | A | A | B |
| | g | A | A | B |
| | h | A | A | A |
| | i | B | B | B |

| | CHART | SINGLE SURFACE | DUPLEX PRINTING (EVALUATION ON 1ST SIDE) | DUPLEX PRINTING (EVALUATION ON 2ND SIDE) |
|---|---|---|---|---|
| | a | B | B | A |
| | b | B | B | A |
| | c | A | A | A |
| | d | A | A | A |
| | e | A | A | A |
| | f | A | A | A |
| | g | A | A | A |
| | h | A | A | A |
| | i | A | A | A |

FIXING UNIT AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2010-176786, filed on Aug. 5, 2010 in the Japan Patent Office, which is hereby incorporated herein by reference in its entirety.

BACKGROUND OF THE INVENTION

1. Field of the Invention

Exemplary aspects of the present invention generally relate to an electrophotographic image forming apparatus, such as a copier, a facsimile machine, a printer, or a multi-functional system including a combination thereof, that forms an image using toner.

2. Description of the Background Art

Related-art image forming apparatuses, such as copiers, facsimile machines, printers, or multifunction printers having at least one of copying, printing, scanning, and facsimile functions, typically form an image on a transfer medium such as a sheet of paper according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to make the electrostatic latent image visible as a toner image; a transfer device transfers the toner image directly from the image bearing member onto a transfer medium or transfers the toner image from the image bearing member onto a transfer medium via an intermediate transfer member; a cleaning device then cleans the surface of the image carrier after the toner image is transferred from the image carrier onto the transfer medium; finally, a fixing device applies heat and pressure to the transfer medium bearing the unfixed toner image to fix the unfixed toner image on the transfer medium, thus forming the image on the transfer medium.

Typically, a guide member disposed at the entrance of the fixing device guides a transfer medium, onto which the toner image is transferred, to a fixing nip defined by and between a fixing member and a pressing member of the fixing device. Heat and pressure are applied to the transfer medium, thereby fixing the toner image in place on the transfer medium. The guide member needs to convey the transfer medium reliably from the transfer device to the fixing device. Reliable conveyance of the transfer medium depends largely on the shape and electrical characteristics of the surface of the guide member. For example, if friction between the guide member and the transfer medium is significant, an electrostatic charge builds up on the guide member and stored charge of the transfer medium fluctuates, causing unfixed toner on the transfer medium to scatter uncontrollably. In particular, toner tends to scatter more easily with a transfer medium having relatively high resistance in a low-humidity environment. When such a transfer medium is guided by the guide member, friction between the leading edge of the guide member and the transfer medium becomes significant, so that the leading edge of the guide member is frictionally charged too much, increasing the electric potential and thus strengthening the electric field generated between the guide member and the fixing roller, which in turn generates an electrical discharge (leak) therebetween when the transfer medium enters the fixing nip. As a result, the unfixed toner in the toner image on the transfer medium scatters uncontrollably. Typically, the guide member tends to be frictionally charged easily after a certain period of operation, for example, after processing approximately 100 transfer media sheets.

Furthermore, when the toner image includes a significant amount of the colors red, green, blue, and the like consisting of two toners among magenta, cyan, and yellow, any difference between the electric potential of the transfer medium and the electric potential of the guide member causes the toner in the unfixed toner image to scatter uncontrollably. This phenomenon is referred to as two-toner scattering. Because the guide member is formed of electrically grounded sheet metal, the surface potential of the guide member is 0 V. Thus, there is a difference in the electric potential between the guide member and the transfer medium, causing the toner to scatter.

Moreover, in a case in which absorption or a contact force of the guide member relative to the transfer medium is strong, an image defect occurs easily at the guide member.

In view of the above, the guide member is coated with a film consisting of combination of metallic and ceramic particles, or a fluorocarbon resin film whose volume resistance is adjusted. In this configuration, the electrical characteristics of the surface of the guide member are adjusted so that the transfer medium can be transported reliably in both high- and low-humidity environments in which the electrical characteristics normally fluctuate.

Although advantageous, because the guide member is formed of molded resin coated with fluorocarbon resin, an electrical charge accumulates at the guide member over time (after processing approximately 100 transfer media sheets), causing the problems described above.

In another approach, the surface of the guide member is provided with a releasable/slidable layer laminated on an elastic sheet to reduce friction between the transfer medium and the guide member when the transfer medium comes into contact with the guide member, hence preventing deterioration of imaging quality. However, in order to produce the guide member coated with material to adjust the electrical characteristics of the surface of the guide member to reduce toner scattering caused by frictional charging, the known approaches described above require a number of manufacturing steps including initial processing of a base material, quenching, heating/drying, cooling, coating, and calcining. If the coating includes multiple layers, coating time, speed, angle, and so forth depend on types of coating compositions, thus complicating manufacture to achieve desired electrical and mechanical characteristics.

SUMMARY OF THE INVENTION

In view of the foregoing, in one illustrative embodiment of the present invention, a fixing unit for fixing a toner image includes a fixing device and a guide member. The fixing device includes a fixing roller having a heater inside thereof and a pressing roller disposed opposite the fixing roller. The pressing roller presses against the fixing roller to fix a toner image formed on a transfer medium. The guide member guides the transfer medium to the fixing device. The guide member includes a metal base member including at least one coating layer.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein:

FIG. 20 is a table showing a relation between the thickness and the electric potential of the coating layer of the guide member, the electric field, and toner scattering;

FIGS. 21A and 21B are tables showing results of image evaluations with different thicknesses of the coating layer and accelerated tests;

DETAILED DESCRIPTION OF ILLUSTRATIVE EMBODIMENTS

Figure 1:
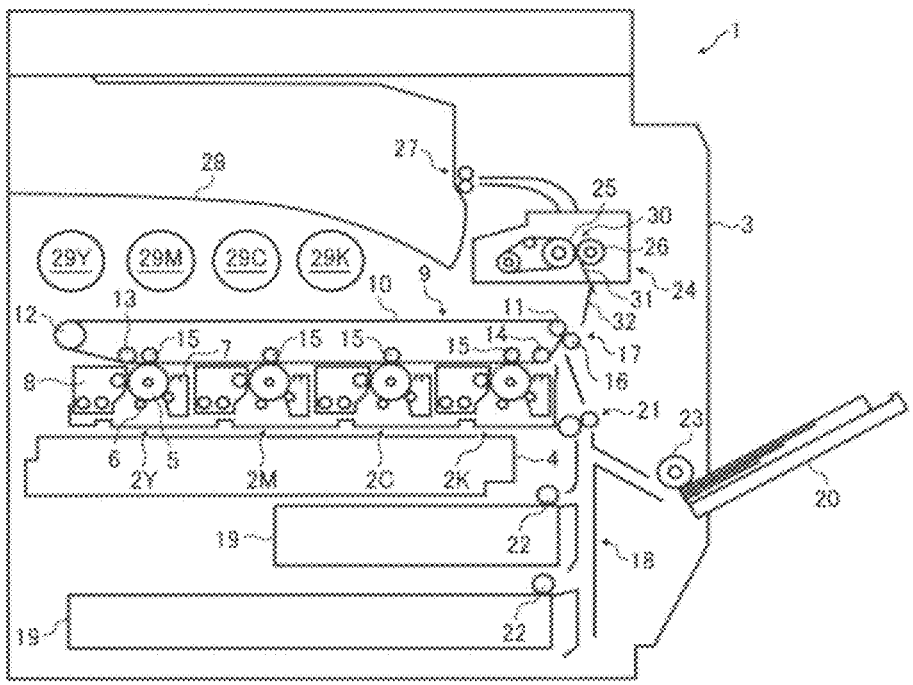
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such teems are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating an image forming apparatus 1. The image forming apparatus 1 includes a main body 3. In the main body 3, image forming stations 2Y, 2M, 2C and 2K for forming images of yellow, magenta, cyan, and black are arranged in tandem and removably installable. It is to be noted that the suffixes Y, M, C, and K denote colors yellow, magenta, cyan, and black, respectively. To simplify the description, these suffixes Y, M, C, and K indicating colors are omitted herein, unless otherwise specified.

An optical writing unit 4 is disposed at the bottom of the image forming stations 2Y, 2M, 2C, and 2K, to illuminate the image forming stations 2Y, 2M, 2C, and 2K with laser beams. The image forming stations 2Y, 2M, 2C, and 2K all have the same configuration, differing only in the color of toner employed. Thus, a description is provided of the image forming station 2Y as a representative example of the image forming stations.

The image forming station 2Y includes a photoconductive drum 5, a charging device 6, a cleaning device 7, a developing device 8, and so forth. The charging device 6, the cleaning device 7, and the developing device 8 are disposed around the photoconductive drum 5 and removably installable in an axial direction of the photoconductive drum 5.

Substantially above the image forming stations 2Y, 2M, 2C, and 2K, toner bottles 29Y, 29M, 29C, and 29K, storing toner of yellow, magenta, cyan, and black, are disposed, respectively. The toner in the toner bottles 29Y, 29M, 29C, and 29K is supplied to the respective developing devices 8.

An intermediate transfer unit 9 is disposed substantially above the image forming stations 2Y, 2M, 2C, and 2K. The intermediate transfer unit 9 is a two-axis intermediate transfer unit in which a transfer belt 10 is wound around at least two rollers. The intermediate transfer unit 9 includes the transfer belt 10 serving as an intermediate transfer member, support rollers 11, 12, 13, and 14, primary transfer rollers 15, a secondary roller 16, and so forth. The support rollers 11, 12, 13, and 14 are disposed inside the loop formed by the transfer belt 10 and rotatably support the transfer belt 10.

The primary transfer rollers 15 are disposed inside the loop formed by the transfer belt 10, each facing the photoconductive drums 5 of the image forming stations 2Y, 2M, 2C, and 2K. The primary transfer rollers 15 transfer toner images formed on the photoconductive drums 5 onto the transfer belt 10 so that the toner images are superimposed one atop the other, thereby forming a composite toner image.

The secondary transfer roller 16 is disposed outside the loop formed by the transfer belt 10, to transfer the composite toner image from the transfer belt 10 onto a transfer medium such as paper. The secondary transfer roller 16 is moved by a moving device, not illustrated, so that the secondary transfer roller 16 can contact and separate from the transfer belt 10.

The transfer belt 10, the support roller 11, and the secondary transfer roller 16 constitute a transfer system 17. In addition, the transfer system 17 may include the two-axis intermediate transfer unit 9. The transfer system 17 is not limited to the configuration described above, and may employ a known transfer device. The transfer system 17 may employ a roller-type transfer member, instead of the transfer belt 10. The transfer system 17 may employ a belt-type secondary transfer member, instead of the secondary transfer roller 16.

The transfer belt 10 has a multilayer structure including a base layer and a coating layer provided on the base layer. The base layer is made of less elastic material. The coating layer is made of material having good slidability. The material for the base layer includes, but is not limited to, fluorocarbon resin, a physical vapor deposition (PVD) sheet, and polyimide resin. The coating layer includes, for example, fluorocarbon resin having good slidability.

Although not illustrated, the transfer belt 10 is provided with an alignment guide, not illustrated, at the edge portion of the transfer belt 10. The alignment guide is formed of rubber such as urethane rubber and silicone rubber, to prevent the transfer belt 10 to drift in the direction of the width of the transfer medium while moving.

A sheet feeding unit 18 is disposed substantially below the optical writing unit 4. The sheet feeding unit 18 includes a plurality of sheet cassettes 19, a manual feed tray 20, a pair of registration rollers 21, and so forth. Each of the plurality of sheet cassettes 19 is equipped with a sheet feed roller 22 that picks up and sends a top sheet of the stack of the transfer media sheets to the pair of registration rollers 21. The manual feed tray 20 is provided with a sheet feed roller 23 that picks up and sends the top sheet of the transfer media sheets on the manual feed tray 20 to the pair of registration rollers 21.

At the upper right of the intermediate transfer unit 9, a fixing unit 24 is disposed. The fixing unit 24 includes a fixing mechanism 30 including a fixing roller 25 and a pressing roller 26. The fixing roller 25 is equipped with a heat source inside thereof. The pressing roller 26 presses against the fixing roller 25, thereby forming a fixing nip therebetween. In the fixing unit 24, the toner image transferred onto the transfer medium by the transfer system 17 is fixed using heat and pressure. As will be described later, the fixing unit 24 includes a guide member 31 to guide the transfer medium.

With reference to FIG. 1, a description is provided of image forming operation. First, in the image forming station 2Y, the photoconductive drum 5 is charged by the charging device 6. Then, the photoconductive drum 5 is illuminated with a laser beam projected by the optical writing unit 4, thereby forming an electrostatic latent image on the surface of the photoconductive drum 5. The electrostatic latent image on the photoconductive drum 5 is developed with toner by the developing device 8. In the image forming station 2Y, the electrostatic latent image is developed with toner of yellow, thus forming a visible image, also know as a toner image, of the color yellow.

Subsequently, the toner image of the color yellow formed on the surface of the photoconductive drum 5 is primarily transferred onto the transfer belt 10 by the primary transfer roller 15. This process is known as a primary transfer process.

After the primary transfer process, the photoconductive drum 5 is cleaned by the cleaning device 7 in preparation for the subsequent imaging cycle.

The residual toner collected by the cleaning device 7 is stored in a waste toner bin, not illustrated, disposed removably installable in the direction of installation of the imaging station 2Y. When the waste toner bin is full, the waste toner bin is replaced.

Similar to the image forming station 2Y, the same image forming operation is performed in the image forming stations 2M, 2C, and 2K. Toner images of the respective colors are formed on the photoconductive drums 5. The toner images of the colors yellow, magenta, cyan, and black formed on the surface of the photoconductive drums 5 are primarily transferred onto the intermediate transfer belt 10 in this order so that they are superimposed one atop the other, thereby forming a composite toner image.

The transfer medium is fed to the pair of registration rollers 21 from the sheet cassette 19 of the sheet feeding unit 18 or from the manual feed tray 20 one sheet at a time. The pair of the registration rollers 21 stops the transfer medium temporarily and sends it to the transfer system 17 in appropriate timing such that the transfer medium is aligned with the composite toner image primarily transferred on the transfer belt 10. Subsequently, the composite toner image primarily transferred on the transfer belt 10 is secondarily transferred onto the transfer medium by the secondary transfer roller 16. Accordingly, the full-color toner image is transferred onto the transfer medium.

The transfer medium bearing the full-color toner image is sent to the fixing unit 24. In the fixing unit 24, the fixing mechanism 30 fixes the toner image on the transfer medium. Subsequently, the transfer medium is discharged by a pair of sheet discharge rollers 27 onto a sheet tray 28. The sheet tray 28 is disposed substantially above the image forming stations 2Y, 2M, 2C, and 2K.

Next, a description is provided of the guide member 31 according to the illustrative embodiment of the present invention. As illustrated in FIG. 1, the guide member 31 is disposed at an entrance of the fixing unit 24, between the transfer system 17 and the fixing unit 24 to guide the transfer medium on which the toner image is transferred by the transfer system 17, to the fixing mechanism 30. According to the illustrative embodiment, the transfer medium is transported laterally. Alternatively, the transfer medium may be transported horizontally.

According to the illustrative embodiment, the image forming apparatus 1 employs an intermediate transfer system. Alternatively, the image forming apparatus may employ a direct transfer system.

According to the illustrative embodiment, a guide plate 32 is disposed upstream from the guide member 31 in the direction of conveyance of the transfer medium. The guide plate 32 guides the transfer medium discharged from the transfer system 17 to the guide member 31. Alternatively, the guide member 31 and the guide plate 32 may be constituted as a single integrated member. In such a case, the single integrated member may serve as both an exit guide that guides the transfer medium exiting the transfer system 17 and the guide member that guides the transfer medium to the fixing unit 24.

Figure 11:
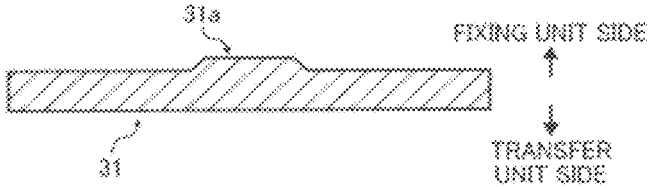
FIG. 11 is a top view of a leading edge portion of the guide member according to an illustrative embodiment of the present invention.

As will be later described, according to the illustrative embodiment, the guide member 31 includes a protrusion 31*a* (shown in FIG. 11). Alternatively, a flat guide member may be employed.

Figure 2:
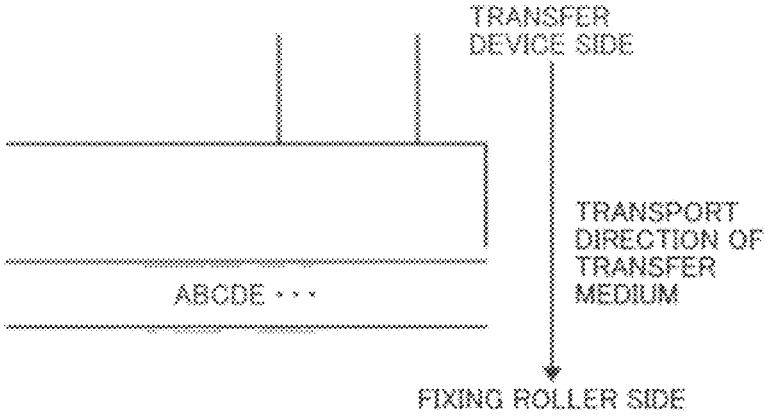
FIG. 2 is a schematic diagram illustrating an example of uncontrolled toner scattering.

In order to facilitate an understanding of the related art and of the novel features of the present invention, with reference to FIG. 2, a description is provided of scattering of toner when using a related-art guide member that guides the transfer medium to the fixing unit. FIG. 2 is a schematic diagram illustrating an example of scattering of toner. As illustrated in FIG. 2, toner scatters in the direction of conveyance of the transfer medium. This is referred to as frontward scattering.

The transfer medium contacts forcibly the leading edge of the guide member, charging frictionally the guide member. When a coating layer of the leading edge of the guide member is relatively thick (for example, approximately 140 μm at maximum), a surface potential of the guide member is relatively high because the surface potential is proportional to the thickness of the coating according to an equation below.

$$V=Qd/(\in S) \qquad \text{Equation 1,}$$

where V is a surface potential on the guide member, d is a thickness of the coating layer of the guide member, $\in$ is relative permittivity, and Q is an electric charge on the guide member. As the surface electric potential increases, an electric field is generated in the direction of conveyance of the transfer medium from the guide member to the fixing unit. This electric field causes the toner on the transfer medium to scatter towards the front in the direction of conveyance of the transfer medium (frontward scattering).

Here, the surface potential of the fixing roller is in a range from 0 V to 400 V which is lower than that of the guide member. Consequently, the difference in the electric potential between the guide member and the fixing roller is significant, thereby generating a high electric field. In this example, a process linear velocity is 230 mm/sec. A secondary transfer electric current is 34 μA in a single color mode, and 50 μA in a color mode.

As described above, when an image consists of significant amount of colors red, green, blue, and the like, the two-toner scattering occurs easily. As the amount of toner adhered to the transfer medium increases, the toner image is easily affected by the electric field and a contact force. Because the transfer medium comes into contact with a flat portion of the guide member (except 1 mm to 3 mm from the leading edge of the guide member) first, the transfer medium is affected easily by the electric field at the time of contact. The frontward scattering is caused by an increase in the electric potential of the leading edge of the guide member frictionally charged by contacting the transfer medium over time. By contrast, the two-toner scattering is caused by the contact force and the electric field immediately after the toner contacts the guide member. Hence, the two-toner scattering occurs on the first sheet of the transfer medium.

If the guide member 31 is made of stainless steel and connected to ground, toner scatters easily when the transfer medium with the electric potential contacts the guide member of 0V. More particularly, when the amount of toner borne on the transfer medium is relatively large, the toner scatters easily. This is because the electric field fluctuates rapidly when such a transfer medium contacts the guide member of 0V.

In view of the above, the flat portion of the guide member (except 1 mm to 3 mm from the leading edge thereof) should not be made of stainless steel connected to ground. For this reason, the guide member needs to include a coating layer that can maintain a certain amount of surface potential, and the minimum thickness of the coating layer needs to be approximately 20 μm.

Figure 3:
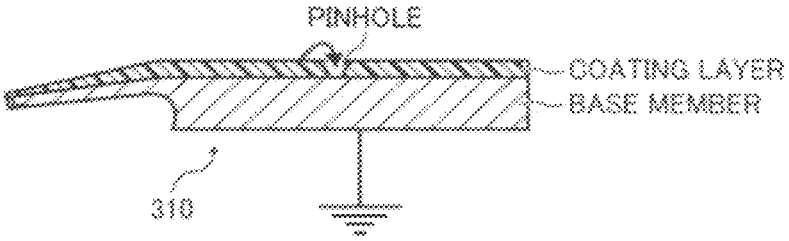
FIG. 3 RELATED ART
FIG. 3 is a schematic diagram illustrating a related-art guide member when a coating layer thereof is relatively thick.
Figure 4:
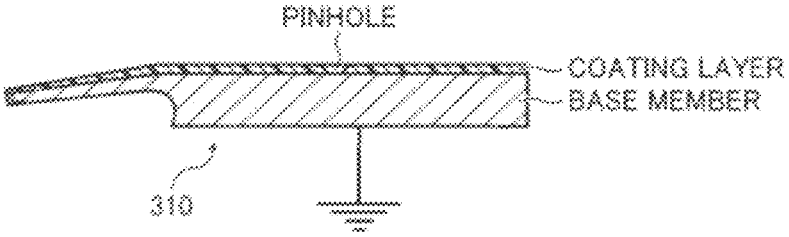
FIG. 4 RELATED ART
FIG. 4 is a schematic diagram illustrating a related-art guide member when a coating layer thereof is relatively thin.

In order to facilitate an understanding of the related art and of the novel features of the present invention, with reference to FIGS. 3 and 4, a description is provided of toner scattering caused by a pinhole in a coating layer of a related-art guide member. FIG. 3 is a schematic diagram illustrating a related-art guide member 310 when a coating layer thereof is thick. FIG. 4 is a schematic diagram illustrating another example of the related-art guide member 310 when a coating layer thereof is thin.

Figure 29:
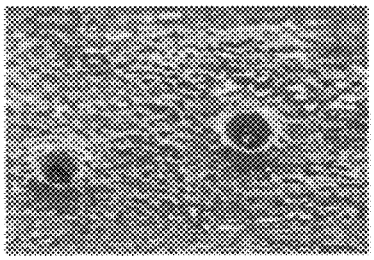
FIG. 29 is a photograph showing an example of a pinhole in a guide member.
Figure 30:
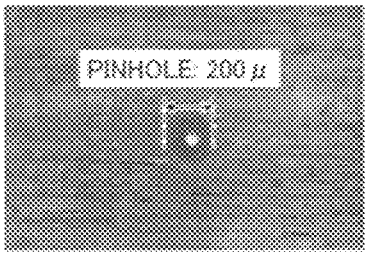
FIG. 30 is a close-up of the pinhole in the guide member.
Figure 31:
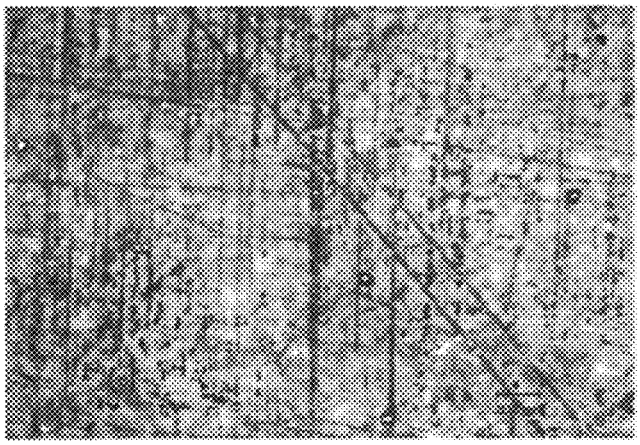
FIG. 31 is a photograph showing the guide member without the pinhole.
Figure 32:
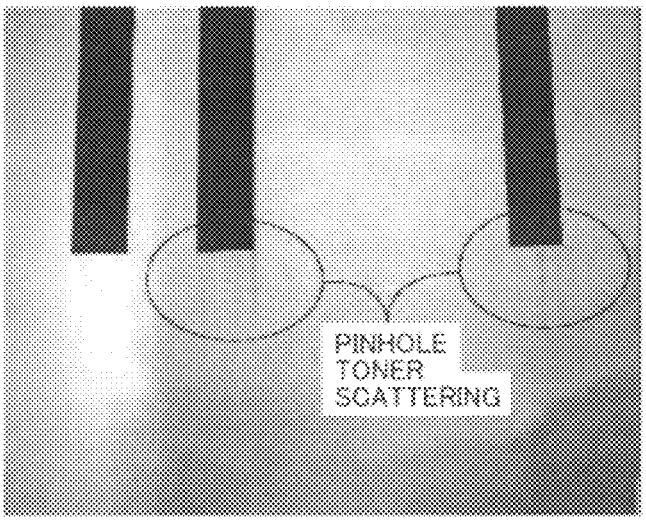
FIG. 32 is a schematic diagram illustrating toner scattering caused by the pinhole in the guide member.
Figure 33:
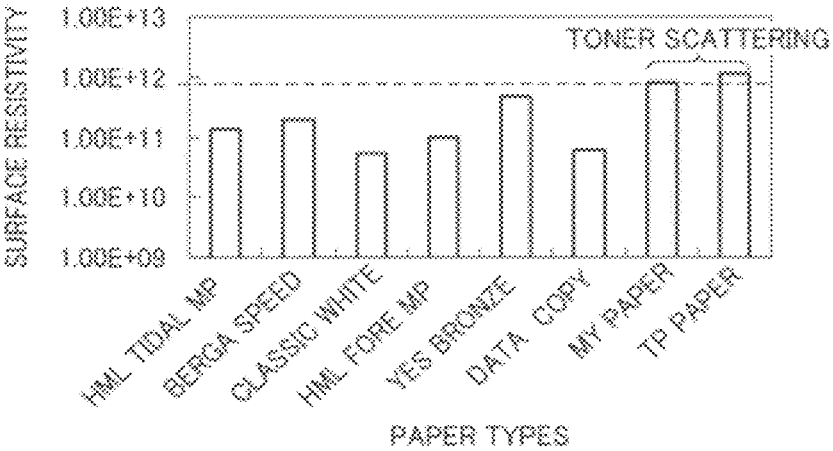
FIG. 33 is a graph showing surface resistivity and toner scattering for different types of paper.

As illustrated in FIG. 3, in a case in which the coating layer of the guide member 310 is thick, the surface potential of the coating layer is high. If the surface potential of the coating layer is high and the coating layer has a pinhole (undesirable hole often reaching the base member of the guide member 310) such as shown in FIGS. 29 and 30, the electric field between the base member and the coating layer becomes high, resulting in toner scattering at the pinhole as shown in FIG. 32, for example. The example of the pinhole is shown in FIGS. 29 and 30. FIG. 31 shows an example of a guide member without the pinhole.

When the electric potential of the coating layer is high and a surface roughness of the base member is high, a portion of the surface of the base member having a high surface roughness serves as a lightning rod to which leak of charges concentrates. As a result, toner scatters.

Figures 5, 6:
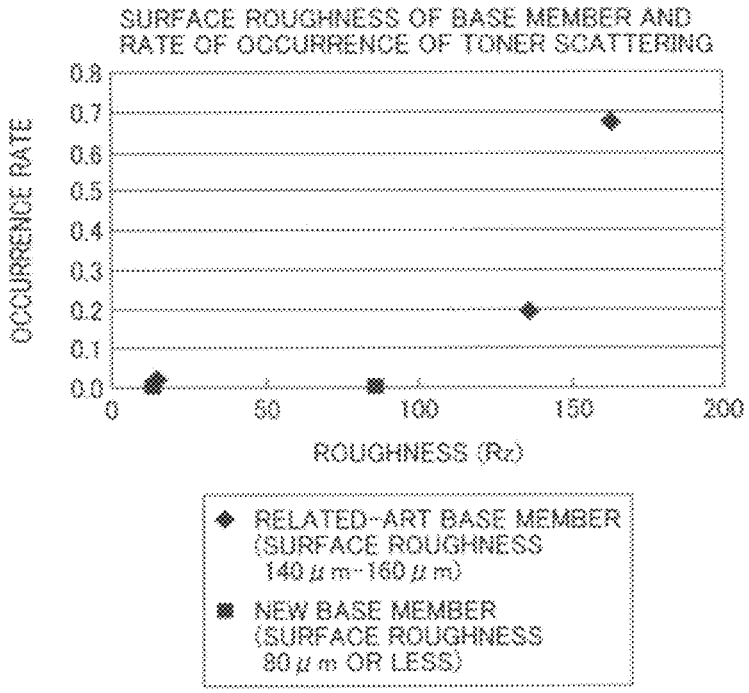
FIG. 5 is a graph showing a relation between a surface roughness of a base member of a guide member and a rate of occurrence of toner scattering.
FIG. 6 is a table showing a relation between a rate of occurrence of toner scattering, a diameter of a pinhole, and a thickness of the coating layer.

Referring now to FIG. 5, a description is provided of a relation between the surface roughness of the base member and the rate of occurrence of toner scattering in a low-humidity environment studied by the present inventor. FIG. 5 is a graph showing a relation between the surface roughness (Rz) of the base member and the rate of occurrence of toner scattering including, two-toner rearward scattering in which two toners among magenta, cyan, and yellow scatter at a pinhole in the direction opposite the direction of transport of the transfer medium.

As shown in FIG. 5, when the surface roughness of the base member was equal to or less than a 10-point average roughness Rz of 75 μm, toner did not scatter uncontrollably. Therefore, the surface roughness Rz of the base member needs to be equal to or less than 75 μm.

By contrast, in a case in which the coating layer is thin as illustrated in FIG. 4, the surface potential of the coating layer is low, and the electric field between the base member and the coating layer is weak. Therefore, toner does not scatter even if the coating layer includes a pinhole that reaches the base member.

Referring now to FIG. 6, a description is provided of the rate of occurrence of toner scattering with different diameters of the pinhole and different thicknesses of the coating layer. FIG. 6 is a table showing a relation between the rate of occurrence of toner scattering, the diameter of the pinhole, and the thickness of the coating layer, studied by the present inventor. As shown in FIG. 6, when the diameter of the pinhole was equal to or less than 170 μm and the thickness of the coating layer was equal to or less than 40 μm, toner did not scatter.

Figure 7:
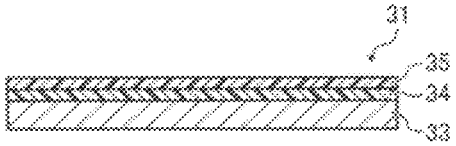
FIG. 7 is a schematic cross-sectional diagram illustrating a guide member according to an illustrative embodiment of the present invention.

With reference to FIG. 7, a description is provided of the guide member 31 according to the illustrative embodiment of the present invention. FIG. 7 is a schematic cross-sectional diagram illustrating the guide member 31.

As illustrated in FIG. 7, the guide member 31 includes a base member 33, a first coating layer 34 on the base member 33, and a second coating layer 35 on the first coating layer 34. The base member 33 is made of a sheet metal such as aluminum, stainless steel, and iron. The first coating layer 34 and the second coating layer 35 are insulating. By applying the first coating layer 34 on the base member 33 to adhere the second coating layer 35 and the base member 33 together, the characteristics different from the base member 33, for example, the characteristics of fluorocarbon resin or the like are provided to the front surface of the guide member 31. Such characteristics include, but are not limited to, electric insulation, a nonstick property, acid resistance, slidability, and corrosion control.

According to the present embodiment, for the base member 33, a chromate-free electrolytic zinc-coated steel sheet manufactured by Nippon Steel Corporation is used to prevent corrosion. The first coating layer 34 may be formed of an inorganic material in view of conductivity, coating performance, and good adhesion with the second coating layer 35.

Figure 8:
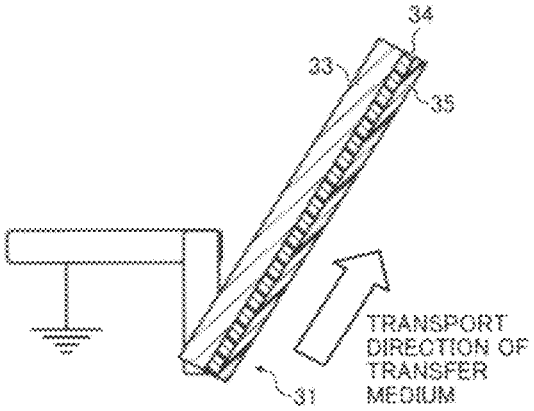
FIG. 8 is a schematic diagram illustrating the guide member of FIG. 7 when a base member thereof is connected to ground.
Figure 9:
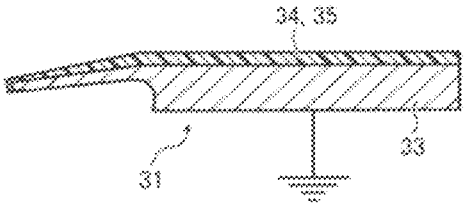
FIG. 9 is a schematic diagram illustrating the guide member connected to ground according to an illustrative embodiment of the present invention.

As illustrated in FIGS. 8 and 9, toner scattering is prevented when the base member 33 is connected to ground, while satisfying the electric field, the electric potential, and the amount of charge as described above. FIG. 8 is a schematic diagram illustrating the guide member 31 connected to ground. FIG. 9 is a schematic diagram illustrating another example of the guide member 31 connected to ground. In FIG. 8, the guide member 31 guides the transfer medium vertically.

Figure 10:
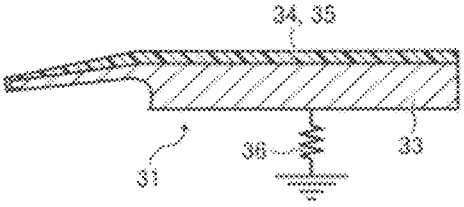
FIG. 10 is a schematic diagram illustrating the guide member connected to ground via a varistor.

As long as the above-described electric field, the electric potential, and the amount of charge are satisfied, the guide member 31 may be connected to ground via a resistive element 36 or a varistor, as illustrated in FIG. 10. FIG. 10 is a schematic diagram illustrating the guide member 31 connected to ground via a varistor.

The guide member 31 includes at least one coating layer on the base member 33. According to the illustrative embodiment, the guide member 31 includes two coating layers, that is, the coating layers 34 and 35, each made of fluorocarbon resin including polytetrafluoroethylene resin. The thickness of a flat portion of the first coating layer 34 except the leading edge portion is in a range of 10 μm to 20 μm. The thickness of a flat portion of the second coating layer 35 except the leading edge portion is in a range of 20 μm to 30 μm. Accordingly, the sum of the thickness of the first coating layer 34 and the second coating layer 35 is equal to or less than 50 μm.

The coating layers made of polytetrafluoroethylene resin which serve as an insulating resistor are formed on the metal sheet of the guide member 31. This configuration is advantageous in that the surface resistivity of the guide member 31 is in the range of mid to high surface resistivity (for example, in the range of $10^6$ to $10^{14}\Omega/\square$). The thickness of the leading edge portion needs to be thin.

According to the illustrative embodiment, the guide member 31 includes two coating layers, the first coating layer 34 and the second coating layer 35. However, as long as the desired electric field, electric potential, and electric charge are achieved, the guide member 31 may include one coating layer. What is important here is that the electric potential of the leading edge of the guide member 31 needs to be lower than the electric potential of the flat portion except the protruding portion 31*a* (shown in FIG. 11). FIG. 11 is a plan view of the leading edge of the guide member according to an illustrative embodiment of the present invention.

According to the illustrative embodiment, coating liquid used in the coating layers 34 and 35 is a modified Teflon (registered trademark) manufactured by DU PONT-MITSUI FLUOROCHEMICALS COMPANY, LTD. More specifically, the coating liquid used for the first coating layer 34 is modified by adding an adhesive component to enhance adhesiveness so that the first coating layer 34 adheres to the base member 33 reliably. Alternatively, as long as the predetermined potential and the layer thickness are maintained, other fluorocarbon resin may be employed.

Next, a description is provided of the first coating layer 34 and the second coating layer 35.

The fluorocarbon resin coating is classified into two categories based on its function: one is a primer serving as a base coat (Here, the first coating layer 34), and the other is a top coat serving as a finish coat (Here, the second coating layer 35). The component of the primer consists of an adhesive component and fluorocarbon resin to adhere the base member 33 and the top coat. By contrast, the top coat consists of fluorocarbon resin so that advantageous characteristics of the fluorocarbon resin are provided to the surface of the guide member 31.

Figure 12:
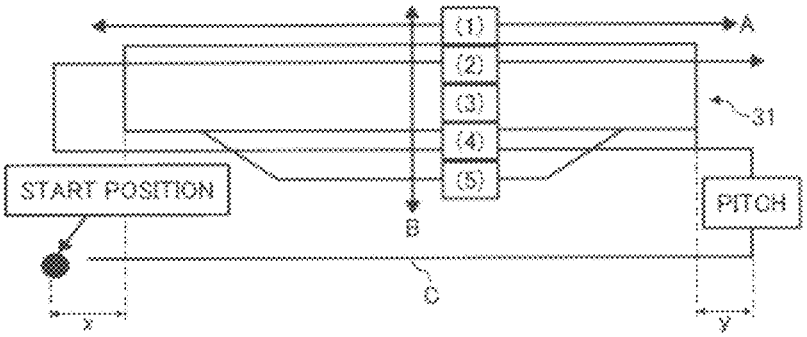
FIG. 12 is a schematic diagram illustrating application of a fluorocarbon resin layer on the guide member according to an illustrative embodiment of the present invention.

With reference to FIG. 12, a description is provided of application of the fluorocarbon resin layer. FIG. 12 is a schematic diagram illustrating application of the fluorocarbon resin layer on the guide member 31 according to an illustrative embodiment of the present invention. Arrows A and B indicate directions of movement of a coating gun that applies the fluorocarbon resin layer. As illustrated in FIG. 12, a start position x for application of the fluorocarbon resin layers is arbitrary. The fluorocarbon resin layers are applied on the guide member 31 from the start position x along a path indicated by an arrow C. As long as the coating layers do not crack, the start position x, the length of excess application y, and a pitch are arbitrarily set.

The speed of application of the coating layers is adjusted to prevent a defect such as a pinhole in the surface of the coating layer and to prevent a void or the like from generating in the coating layers when the coating layers are dried. For example, the application speed may be in a range from 50 mm/sec to 100 mm/sec. The distance between the coating gun and the base member 33 may be in a range from 30 mm to 120 mm, and an air pressure may be in a range from 0.1 to 0.4 MPa. Furthermore, as long as the coating layer adheres to the base member 33 without a crack and/or void, the guide member 31 may include only one layer.

The guide member 31 is formed such that the base member 33 is processed and baked, and a first layer (the primer) is applied to the base member 33 and dried. Subsequently, a second layer (the top coat) is applied, dried, and calcinated. The temperature of calcination depends on the fluorocarbon resin to be used. Typically, the temperature of calcination is in the range from 200° C. to 300° C.

According to the illustrative embodiment, the guide member 31 consists of the metal sheet coated with fluorocarbon resin. With this configuration, the guide member 31 does not get charged over time, for example, even after outputting 100 sheets or more.

Figure 13:
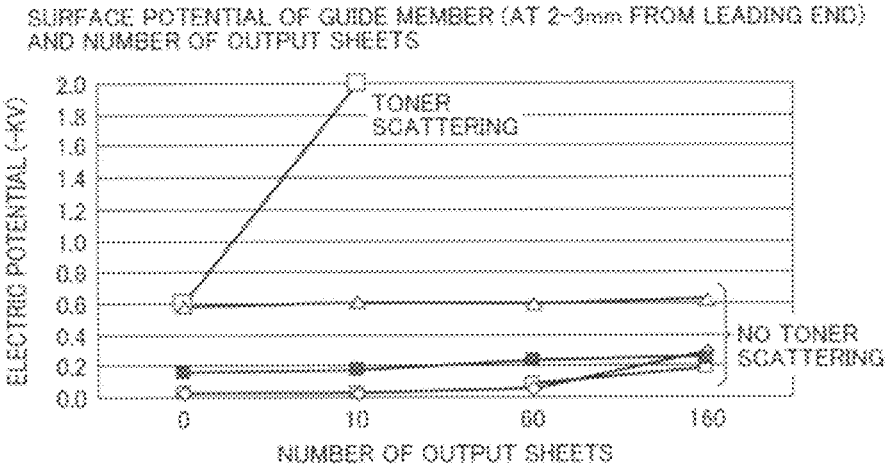
FIG. 13 is a graph showing a relation between an electric potential of the leading edge portion of the guide member and a number of transfer media sheets.

With reference to FIG. 13, a description is provided a relation between the number of transfer media sheets being output and the electric potential of the leading edge (near 2 mm to 3 mm from the leading edge) of the guide member 31. FIG. 13 shows results of an experiment in which the electric potential of the leading edge of the guide member 31 was measured after a certain number of transfer media sheets were output. As shown in FIG. 13, when the electric potential at the leading edge portion rose to 2 kV, toner scattered. However, when the electric potential rose only to 600V, toner did not scatter even after 160 transfer media sheets were output.

Figures 14, 15:
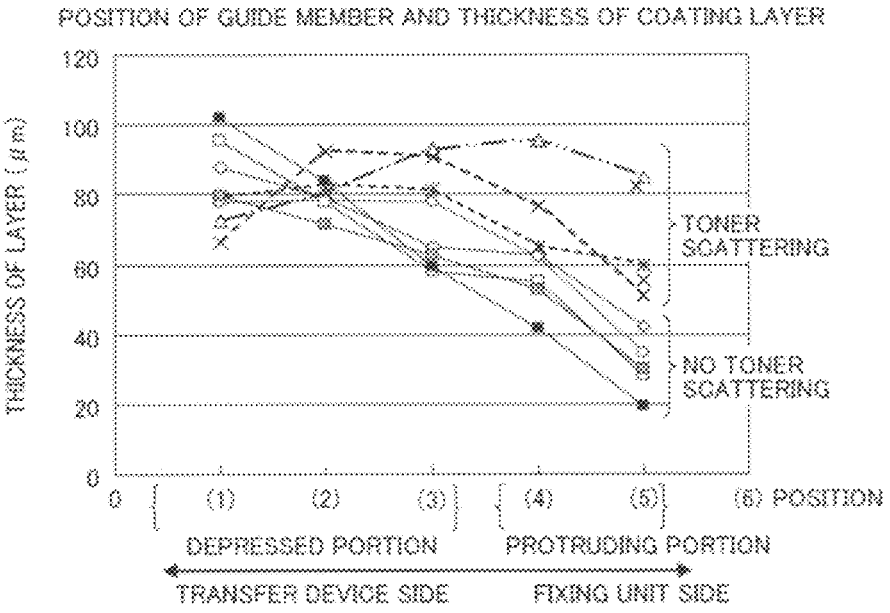
FIG. 14 is a table showing a relation between the electric potential of the leading edge portion of the guide member, an electric field, and toner scattering.
FIG. 15 is a graph showing a relation between the position of the guide member, the thickness of the coating layer, and generation of toner scattering.

As is understood from the experiment, when the electric potential of the leading edge of the guide member 31 is equal to or less than 600V, toner does not scatter. Furthermore, the present inventor studied that when the electric potential at the leading edge of the guide member 31 was equal to or less than 844V, toner did not scatter as shown in FIG. 14. FIG. 14 is a table showing a relation between the electric potential of the leading edge portion of the guide member, the electric field, and toner scattering. In FIG. 14, GOOD indicates that toner did not scatter. POOR indicates that toner scattered.

As is understood from FIG. 14, when the distance between the leading edge of the guide member 31 and the fixing mechanism 30 was 3.64 mm, the electric field was 844V/3.64 mm=$2.32\times10^2$ kV/m. This means that when the electric field is equal to or less than $2.32\times10^2$ kV/m, toner does not scatter. On the other hand, when the electric potential at the leading edge of the guide member 31 was 951V, the electric field was 951V/3.64 mm=$2.61\times10^2$ kV/m and toner scattered.

As shown in FIG. 14, when the position of the guide member 31 was lowered by 3 mm from the condition described above, that is, the distance between the leading edge of the guide member 31 and the fixing mechanism 30 was 6.04 mm, a few transfer media sheets out of 20 sheets showed small toner scattering (approximately 1 mm off the line) at the electric field of $3.31\times10^2$ kV/m.

Figure 18:
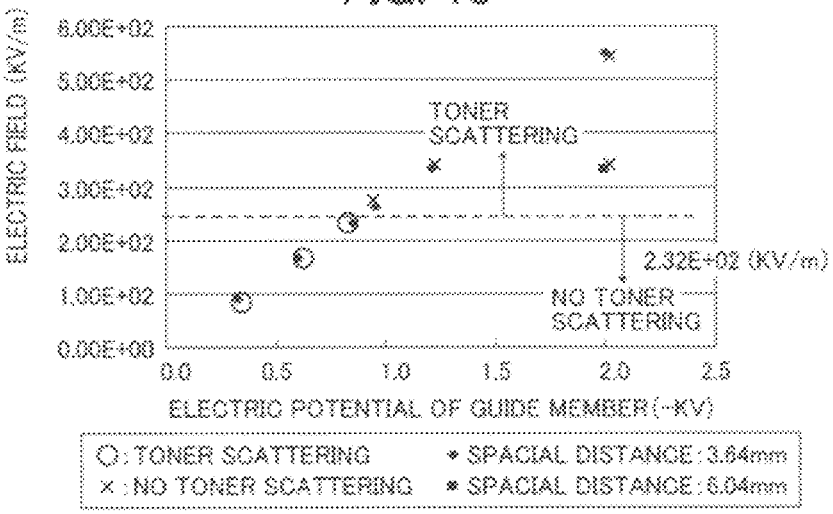
FIG. 18 is a graph showing a relation between the electric potential and the position of the leading edge portion of the guide member, the electric field, and toner scattering.

In order to prevent toner scattering completely under this condition, the electric field needs to be equal to or less than $2.32\times10^2$ kV/m, as shown in FIG. 18. FIG. 18 is a graph showing a relation between the electric potential of the leading edge portion and the position the guide member 31, the electric field, and toner scattering.

The electric charge Q on the second coating layer 35 is $Q=\in\in0\cdot S\cdot V/d$, where the electric potential of the guide member 31 is −840V, a vacuum dielectric constant is $8.85\times10^{-12}$, a relative permittivity of the fluorocarbon resin is 2.1, and the thickness of the coating layer is 46 μm. Hence, when stored charge of the guide member 31 is equal to or less than $3.40\times10^{-4}$ C/m$^2$, an abnormal electrical discharge does not occur.

As illustrated in FIG. 15, when the thickness of the coating layer at the position indicated by (5) in FIG. 15, that is, near 2 mm to 3 mm from the leading edge of the guide member 31, is equal to or greater than 50 μm, toner scatters. As shown in FIG. 15, when the thickness of the coating layer at the position (5) is equal to or less than 46 μm, toner does not scatter.

Protruding portions (4) and (5) in FIG. 15 correspond to the protruding portions (4) and (5) of the guide member 31 shown in FIG. 12. Depressed portions (1) through (3) in FIG. 15 correspond to the depressed portions (1) through (3) of the guide member 31 shown in FIG. 12.

Figure 16:
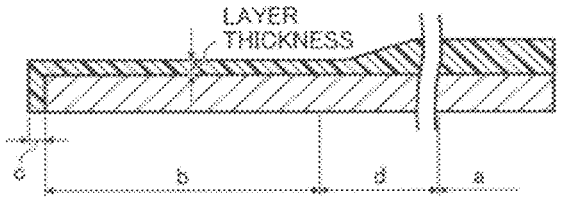
FIG. 16 is a schematic diagram illustrating the thickness and the position of the coating layer of the guide member according to an illustrative embodiment of the present invention.
Figure 17:
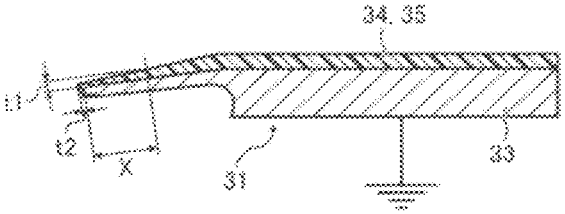
FIG. 17 is a schematic diagram illustrating the thickness and the position of the coating layer of the guide member according to another illustrative embodiment of the present invention.

An area of the coating layer having the thickness of equal to or less than 46 μm needs to be in the area indicated by a suffix "b" in FIG. 16 or a suffix "x" in a range from approximately 1 mm to 3 mm in FIG. 17.

No coating may be applied to the area of the guide member 31 indicated by the suffix c in FIG. 16 or t2 in FIG. 17. According to an experiment using the guide member without coating in an actual image forming apparatus, no significant problem was observed.

As described above, it is desirable that the thickness of the coating layer at the leading edge portion of the guide member 31 be equal to or less than 46 μm. Alternatively, the thickness of the coating layer on the leading edge portion of the guide member 31 at the fixing device side may be 0 μm. That is, only the leading edge portion of the guide member 31 may not include the coating layer. In other words, as long as the electric potential does not increase, the guide member 31 does not have to be coated. Therefore, the thickness of the coating layer may be in a range from 0 μm to 46 μm.

Figure 19:
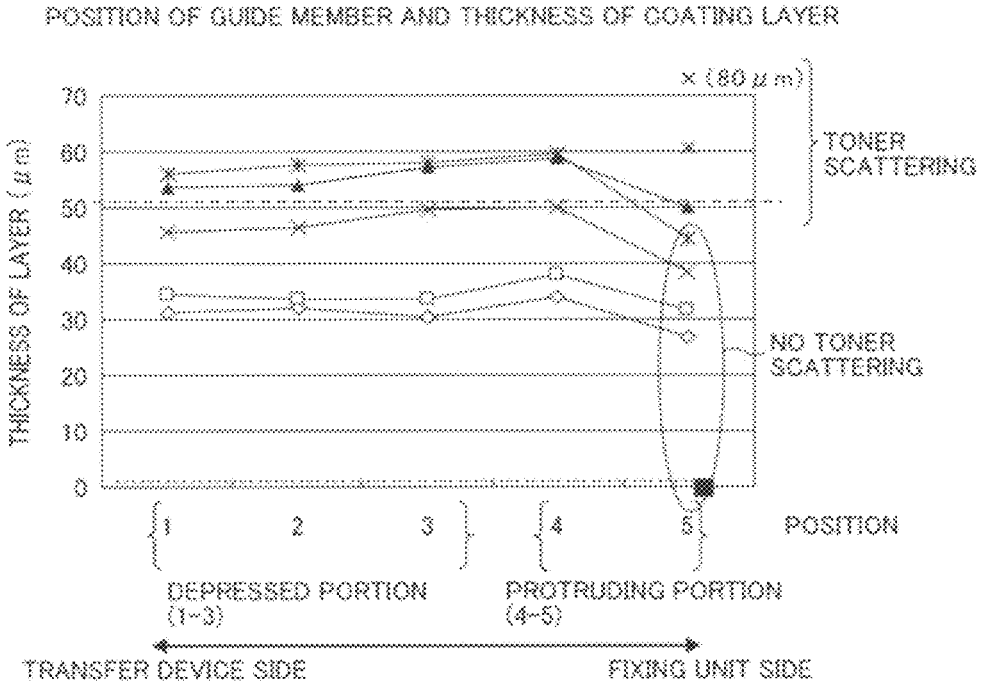
FIG. 19 is a graph showing a relation between the position of the guide member, the thickness of the coating layer, and toner scattering.

With reference to FIG. 19, a description is provided of toner scattering when the thickness of the coating layer of the leading edge portion of the guide member 31 is 0 μm. FIG. 19 is a graph showing a relation between the position of the guide member, the thickness of the coating layer, and toner scattering.

An area of the coating layer having a thickness of 0 μm on a sample guide member, that is, the area indicated by the suffix b in FIG. 16 or the suffix x in FIG. 17, is approximately 3 mm to 4 mm.

FIG. 20 shows results of a more detailed experiment performed by the present inventor as compared with the experiment shown in FIG. 13. FIG. 20 is a table showing a relation between the thickness of the coating layer, the electric potential of the leading edge of the guide member, the electric field, and two-toner frontward scattering. In FIG. 20, GOOD indicates that toner did not scatter. POOR indicates that toner scattered.

In this experiment, the thickness, the electric potential, the electric field, two-toner frontward scattering were studied after outputting 160 transfer media sheets. As is understood from FIG. 20, toner did not scatter in a case in which the electric field was equal to or less than $2.32\times10^2$ kV/m, the surface electric potential of the guide member 31 was equal to or less than 844 V, and the thickness of the coating layer was equal to or less than 46 μm.

As shown in FIG. 16, the distribution of the thickness of the coating layer of the guide member 31 may be substantially flat. Alternatively, the distribution of the thickness may have an angled shape as shown in FIG. 17 in which the thickness becomes thinner toward the leading edge portion of the guide member 31.

With reference to FIG. 21, a description is provided of toner scattering when the thickness of the coating layer is 40 μm and when the thickness of the coating layer is 80 μm. FIG. 21 is a table showing results of image evaluations with different thicknesses of the coating layer under a default condition and accelerated tests. In FIG. 21, DEFAULT SETTING refers to a condition in which the secondary transfer electric current is a default value of the device. In the accelerated tests, mechanical conditions that cause toner scattering were used.

An output image was evaluated when outputting a transfer medium with an image formed on one side, when outputting a transfer medium with an image formed on a first side in duplex printing, and when outputting a transfer medium with an image formed on a second side in duplex printing.

9 different types of charts "a" through "i" were output. For each chart, 20 sheets were used. In FIG. 21, "A" indicates no toner scattered. "B" indicates toner scattering such as toner scattered over the line by 1 mm shown in FIG. 2 occurred on 1 to 2 sheets. "C" indicates toner scattering similar to toner scattering shown in FIG. 2 occurred on 5 to 10 sheets.

As is understood from FIG. 21, under the default setting, when the thickness of the coating layer was 40 μm, toner scattered only when an image was formed on the second side in duplex printing using the chart "a". Toner did not scatter on other charts. (The chart "a" was a chart on which a line image was formed, and hence the toner scattering on this chart was due to the accelerated tests.)

In this experiment, the thickness of the coating layer was measured by using an Eddy current type film thickness meter (LZ-200 manufactured by Kett Electric Laboratory). The film thickness meter was calibrated to take the thickness of the metal sheet portion of the guide member into consideration.

For example, the thickness of the metal sheet at the leading edge is thinner than that of the flat portion. Therefore, the film thickness meter was calibrated in accordance with the thickness of the metal sheet.

Figure 22:
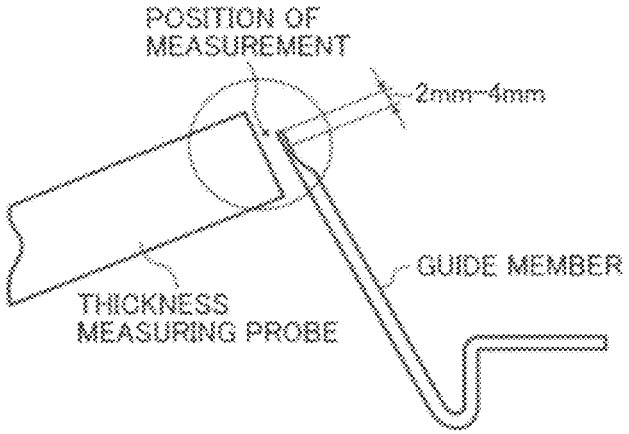
FIG. 22 is a partially enlarged schematic diagram illustrating a 5-by-5 mm measuring probe and the leading edge portion of the guide member.
Figure 23:
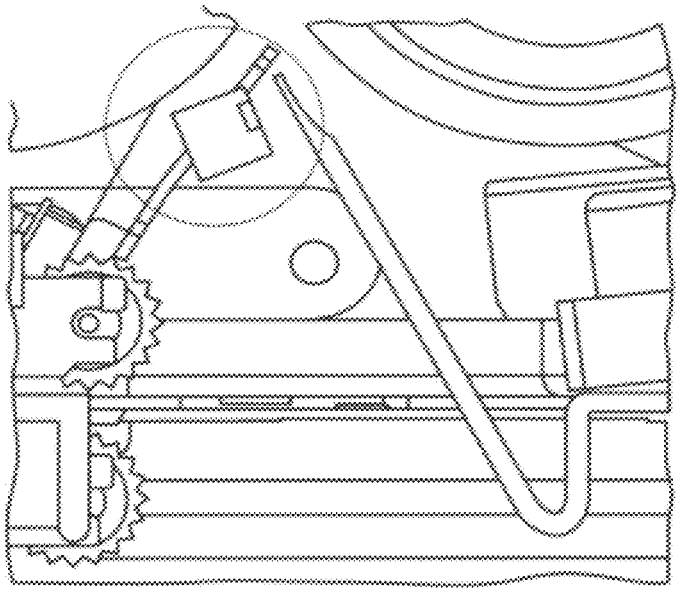
FIG. 23 is a schematic diagram illustrating the measuring probe and the leading edge portion of the guide member disposed in the image forming apparatus.
Figure 24:
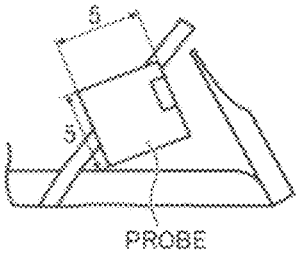
FIG. 24 is a schematic diagram illustrating the size of the measuring prove.
Figure 25:
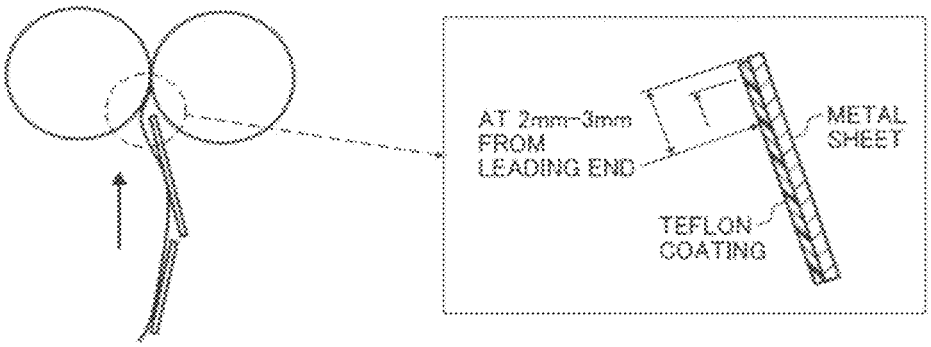
FIG. 25 is a schematic diagram illustrating the measurement of the electric potential of the leading edge portion of the guide member.

With reference to FIGS. 22 through 25, a description is provided of measurement of the electric potential of the coating layer of the leading edge portion. FIG. 22 is a partially enlarged schematic diagram illustrating a 5-by-5 mm measuring probe and the leading edge of the guide member. FIG. 23 is a schematic diagram illustrating the measuring probe and the leading edge of the guide member disposed in the image forming apparatus. FIG. 24 is a schematic diagram illustrating the size of the measuring prove. FIG. 25 is a schematic diagram illustrating measurement of the electric potential of the leading edge of the guide member.

The 5-by-5 mm measuring probe was disposed near the leading edge portion of the guide member, at approximately 2 to 3 mm from the leading edge portion, and the electric potential was measured using a voltmeter manufactured by TREK, INC. Because the 5-by-5 mm measuring probe was used as a measuring device, even a small electric potential at the leading edge portion of the guide member can be measured. Furthermore, the electric potential in the vicinity of the fixing device is measured as compared with a generally-known probe.

Figure 26:
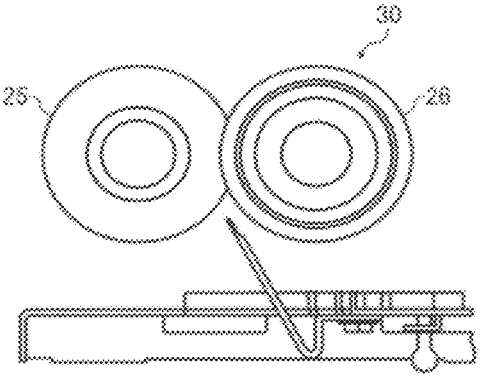
FIG. 26 is a schematic diagram illustrating a fixing device according to an illustrative embodiment of the present invention.
Figure 27:
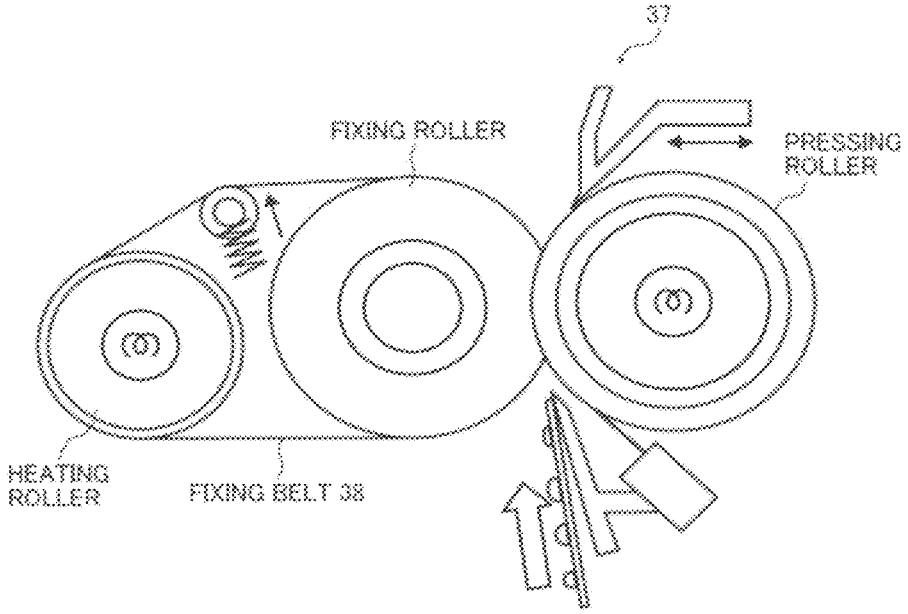
FIG. 27 is a schematic diagram illustrating a fixing device according to another illustrative embodiment of the present invention.

With reference to FIGS. 26 and 27, a description is provided of the fixing mechanism 30 and a belt-type fixing device 37. FIG. 26 is a schematic diagram illustrating the fixing mechanism 30 according to the illustrative embodiment of the present invention. FIG. 27 is a schematic diagram illustrating the belt-type fixing device 37 according to another illustrative embodiment of the present invention.

In the fixing mechanism 30, the fixing roller 25 is a non-conductive member and includes a surface layer made of a silicone form rubber. The pressing roller 26 includes a rubber layer formed of non-conductive silicone rubber serving as a middle layer and a conductive perfluoroalkoxy polymer resin (PFA) tube serving as a surface layer. The surface resistivity has a value of 106 or less.

In FIG. 27, the belt-type fixing device 37 includes a fixing belt 38. The fixing belt 38 consists of a base member formed of polyimide, an intermediate layer formed of rubber such as silicone rubber, and a surface formed of perfluoroalkoxy polymer resin.

The fixing roller 25 is a non-conductive member having a surface electric potential in a range from 0 to a negative voltage of a few hundred V (approximately 400). The pressing roller 26 is conductive and has a surface electric potential of approximately 0V or close to 0V.

Figure 28:
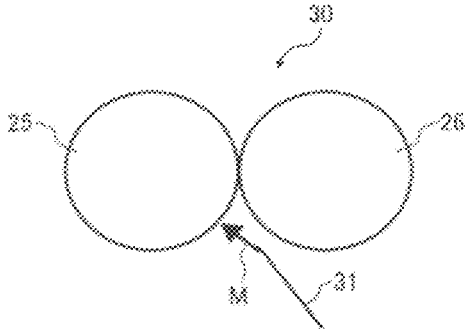
FIG. 28 is a schematic diagram illustrating the fixing device and the guide member for explaining the electric field.

In this configuration, in a case in which the electric potential of the guide member 31 is high, an electric field is generated from the guide member 31 to the fixing roller 25 indicated by an arrow M in FIG. 28.

According to the illustrative embodiment, the material and the shape of the leading edge of the guide member, the electric field from the guide member and the fixing device, the electric potential on the guide member, the thickness of the coating layer at the leading edge of the guide member, an amount of charges of the guide member, the thickness of the flat portion of the guide member, and the diameter of the pinhole formed on the coating layer on the guide member are adjusted to prevent generation of toner scattering, thereby maintaining good imaging quality.

According to the illustrative embodiment, the present invention is employed in the color copier as an example of the image forming apparatus. The image forming apparatus includes, but is not limited to, an electrophotographic image forming apparatus, a copier, a printer, a plotter, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing unit for fixing a toner image, comprising:

a fixing device including a fixing roller and a pressing roller disposed opposite the fixing roller, the fixing roller having a heater inside thereof, the pressing roller pressing against the fixing roller and fixing a toner image formed on a transfer medium; and a guide member to guide the transfer medium to the fixing device, the guide member including a metal base member including at least one coating layer, wherein the guide member comprises:

a leading edge portion facing a direction to which the transfer medium exits; and a portion other than the leading edge portion, wherein the coating layer is formed on the portion other than the leading edge portion, and wherein an electric field generated between the guide member and the fixing device is equal to or less than $2.32\times10^2$ kV/m.

2. The fixing unit according to claim 1, wherein the coating layer is formed of fluorocarbon resin.

3. The fixing unit according to claim 1, wherein the guide member includes a metal portion located at least 1 mm to 3 mm from the leading edge portion.

4. The fixing unit according to claim 1, wherein the coating layer has a thickness equal to or less than 50 μm.

5. The fixing unit according to claim 1, wherein an electric potential generated at the leading edge portion of the guide member is equal to or less than 840 V.

6. The fixing unit according to claim 1, wherein an electrical charge generated on the coating layer is equal to or less than $3.40\times10^{-4}$ C/m$^2$.

7. The fixing unit according to claim 1, wherein the coating layer includes a pinhole having a diameter equal to or less than 170 μm.

8. The fixing unit according to claim 1, wherein the base member of the guide member is connected to ground via a resistive element.

9. The fixing unit according to claim 1, wherein the base member of the guide member is connected to ground via a varistor.

10. An image forming apparatus, comprising the fixing unit of claim 1.

11. The fixing unit according to claim 1, wherein:

a surface roughness of the base member is equal to or less than Rz 75 μm.

12. The fixing unit according to claim 1, wherein:

the portion other than the leading edge portion is a flat portion.

13. A fixing unit for fixing a toner image, comprising:

a fixing device including a fixing rotary body and a pressing roller disposed opposite the fixing rotary body, the fixing rotary body having a heater inside thereof, the pressing roller pressing against the fixing rotary body to fix a toner image formed on a transfer medium; and a guide member to guide the transfer medium to the fixing device, the guide member including a metal base member including at least one coating layer, wherein an electric field generated between the guide member and the fixing device is equal to or less than $2.32\times10^2$ kV/m.

14. The fixing unit according to claim 13, wherein an electric potential generated at the leading edge portion of the guide member is equal to or less than 840 V.

15. The fixing unit according to claim 13, wherein the base member of the guide member is connected to ground.

16. An image forming apparatus comprising the fixing unit of claim 13.

17. A fixing unit for fixing a toner image, comprising:

a fixing device including a fixing rotary body and a pressing roller disposed opposite the fixing rotary body, the fixing rotary body having a heater therein; and a guide to guide the transfer medium to the fixing device, the guide including a metal base member including at least one coating layer, and a protruding portion which protrudes towards the fixing rotary body of the fixing device, wherein the guide is disposed such that when a recording medium travels to the fixing device, the recording medium contacts the protruding portion, wherein the protruding portion is disposed such that a thickness of the guide is thinner before and after the protruding portion, relative to a direction of travel of the recording medium, and wherein an electric potential of a leading edge of the guide is lower than an electric potential of a flat portion of the guide except the protruding portion.

18. An image forming apparatus comprising the fixing unit of claim 17.

19. A fixing unit for fixing a toner image, comprising:

a fixing device including a fixing rotary body and a pressing roller disposed opposite the fixing rotary body, the fixing rotary body having a heater therein; and a guide to guide the transfer medium to the fixing device, the guide including a metal base member including at least one coating layer, and a protruding portion which protrudes towards the fixing rotary body of the fixing device, wherein the guide is disposed such that when a recording medium travels to the fixing device, the recording medium contacts the protruding portion, wherein the protruding portion is disposed such that a thickness of the guide is thinner before and after the protruding portion, relative to a direction of travel of the recording medium, and wherein the protruding portion is a sole protrusion of the guide which protrudes towards the fixing rotary body of the fixing device.

* * * * *